US006179576B1

(12) United States Patent
Morita

(10) Patent No.: US 6,179,576 B1
(45) Date of Patent: Jan. 30, 2001

(54) RECIPROCATING COMPRESSOR

(75) Inventor: Yujiro Morita, Honjo (JP)

(73) Assignee: Sanden Corporation, Gunma (JP)

( * ) Notice: Under 35 U.S.C. 154(b), the term of this patent shall be extended for 0 days.

(21) Appl. No.: 09/395,253

(22) Filed: Sep. 13, 1999

(30) Foreign Application Priority Data

Sep. 17, 1998 (JP) ..... 10-263048

(51) Int. Cl.[7] ..... F04B 1/12; F04B 27/08
(52) U.S. Cl. ..... 417/269; 417/571
(58) Field of Search ..... 417/269, 270, 417/571; 92/79

(56) References Cited

U.S. PATENT DOCUMENTS

| | | | | |
|---|---|---|---|---|
| 3,945,765 | * | 3/1976 | Toyoda et al. | 417/269 |
| 4,283,997 | * | 8/1981 | Takahashi et al. | 92/79 |
| 4,290,345 | * | 9/1981 | Hiraga et al. | 92/79 |
| 4,413,955 | * | 11/1983 | Kato et al. | 417/270 |
| 4,693,674 | | 9/1987 | Fukai et al. | 417/269 |
| 4,880,361 | * | 11/1989 | Ikeda et al. | 417/269 |
| 4,936,754 | * | 6/1990 | Suzuki et al. | 417/269 |
| 5,088,897 | * | 2/1992 | Kawai et al. | 417/269 |
| 5,242,276 | * | 9/1993 | Shimizu | 417/269 |
| 5,429,482 | * | 7/1995 | Takenaka et al. | 417/269 |
| 5,782,613 | * | 7/1998 | Michiyuki et al. | 417/269 |

FOREIGN PATENT DOCUMENTS

| | | | | |
|---|---|---|---|---|
| 61-145884 | | 9/1986 | (JP) | F04B/25/04 |
| 7139463 | | 5/1995 | (JP) | F04B/27/08 |
| 200218 | * | 8/1996 | (JP) | F04B/27/08 |

OTHER PUBLICATIONS

Patent Abstracts of Japan, Publication No. 07–139463, published May 30, 1995.

* cited by examiner

*Primary Examiner*—Teresa Walberg
*Assistant Examiner*—Leonid Fastovsky
(74) *Attorney, Agent, or Firm*—Baker Botts L.L.P.

(57) ABSTRACT

A reciprocating compressor includes a discharge chamber, a suction chamber provided at a radially outer portion around the discharge chamber, and a reciprocating mechanism for compressing a gas introduced through the suction chamber. The compressor comprises a partition wall separating the suction chamber from the discharge chamber, and an outer wall extending along the suction chamber for defining the suction chamber. The outer wall has a plurality of portions projecting toward the partition wall on a radially inner surface of the outer wall, and arranged with an interval in a circumferential direction of the outer wall. Each projecting portion has an arc-projecting surface facing the partition wall, and an inclined surface facing the partition wall and extending from each side of the arc-projecting surface to the radially inner surface of the outer wall. Thus, a gas being compressed may be uniformly distributed from the suction chamber to the reciprocating mechanism.

5 Claims, 4 Drawing Sheets

RECIPROCATING COMPRESSOR

BACKGROUND OF THE INVENTION

1. Field of the Invention

The present invention relates to a reciprocating compressor, and, more specifically, to a reciprocating compressor with an improved structure of a suction chamber suitable for use in a refrigerating cycle of an air conditioner for vehicles.

2. Description of the Prior Art

Generally, in a reciprocating compressor, a gas is introduced from a suction chamber into a reciprocating mechanism having a plurality of bores and a plurality of pistons. The compressed gas by the reciprocating mechanism is introduced into a discharge chamber and then discharged therefrom. The suction chamber and the discharge chamber usually are formed in a cylinder head.

For example, as depicted in FIG. 4, discharge chamber 101 is formed at a radially central portion of cylinder head 102. Suction chamber 103 is formed around discharge chamber 101 to extend in the circumferential direction of discharge chamber 101 at a radially outer portion of discharge chamber 101. Partition wall 104 separates suction chamber 103 from discharge chamber 101. Outer wall 105 defines suction chamber 103. A gas is introduced into suction chamber 103 through suction port 106. The gas is displaced from suction chamber 103 into bores 107 in a cylinder block (not shown). The compressed gas within each bore 107 is displaced into discharge chamber 101, and then discharged from discharge chamber 101 through discharge port 108.

Partition wall 104 has a plurality of concave surfaces 104*a* and a plurality of convex surfaces 104*b* on its radially outer surface. Concave surfaces 104*a* and convex surfaces 104*b* are arranged alternately to form a continuous convex/concave curved surface. Outer wall 105 has a plurality of portions 109 projecting toward the respective concave surfaces 104*a* of partition wall 104 on its radially inner surface 105*a*. Projecting portions 109 are arranged at a predetermined interval in the circumferential direction of outer wall 105. A screw hole 110 is defined in each projecting portion 109. Other than projecting portions 109, the thickness of outer wall 105 is substantially constant.

In a known compressor, suction flow conditions of the gas in bores 107 tend to become nonuniform because suction chamber 103 extends in the circumferential direction and the gas is introduced into suction chamber 103 through suction port 106, which is typically a single port. This condition may cause a decrease of refrigeration ability due to the reduction of the volume efficiency of the suction gas and the occurrence of vibration and noise due to pulsating suction. In particular, as depicted in FIG. 4, two gaps, which have differing widths L1 and L2, are formed in suction chamber 103. Width L1 is formed between the inner surface 105*a* of outer wall 105 and the convex surface 104*b* of partition wall 104. Width L1 is greater than width L2, which is formed between the inner surface of projecting portion 109 of outer wall 105 and the convex surface 104*b* of partition wall 104. Therefore, a gap having width L2 acts as a throttle against the gas flow in suction chamber 103. Consequently, as depicted by arrow A in FIG. 4, a break away flow A may be generated with the gas flow in suction chamber 103 at a position immediate downstream of the gap portion having width L2 in the direction of the gas flow, or at a position of the downstream side of projecting portion 109. Such a break away flow A may increase the pressure loss in the gas flow, may decrease suction efficiency into each bore 107. Further, the volume of the gas sucked into the respective bores 107 may become nonuniform. As a result, in a refrigeration system, the refrigeration ability may decrease. Moreover, break away flow A may cause a pulsation of suction, and it may increase vibration and noise within the compressor.

Japanese Utility Model Laid-Open 61-145884 or JP-A-7-139463 discloses a structure wherein a suction chamber, or a suction path, is formed so as to cross a discharge chamber at a central portion over the discharge chamber, or a structure wherein the height of a narrow portion of a suction chamber is enlarged by heightening a partition wall between the discharge chamber and the suction chamber. However, if a suction chamber is formed to cross over a discharge chamber, then it may be necessary to reduce the height of a discharge chamber in the axial direction of the compressor, or to enlarge the height of the suction chamber. If the narrow portion of the suction chamber is enlarged in the axial direction of the compressor, then the axial length of the entire compressor may increase, and may cause a deterioration of workability for mounting the compressor on a vehicle. Further, in both structures, the weight of a compressor may increase accompanying with the increase of the axial length.

SUMMARY OF THE INVENTION

Accordingly, it is an object of the present invention to provide an improved structure for a reciprocating compressor that may attain a more uniform gas flow in a suction chamber, and may attain a uniform volume of gas sucked from the suction chamber into the bores, thereby improving the volume efficiency of suction that increases the operability of the compressor and reduces the occurrence of vibration and noise.

It is another object of the present invention to provide an improved structure for a reciprocating compressor that may improve the gas flow in the suction chamber without enlarging the axial length of the compressor, thereby providing a compressor having a reduced weight.

To achieve the foregoing and other objects, a reciprocating compressor according to the present invention is herein provided. The reciprocating compressor includes a discharge chamber provided at a radially central portion of the compressor, a suction chamber extending in a circumferential direction of the discharge chamber at a radially outer portion around the discharge chamber, and a reciprocating mechanism for compressing a gas sucked from the suction chamber and discharging the compressed gas into the discharge chamber. The reciprocating compressor comprises a partition wall separating the suction chamber from the discharge chamber, and an outer wall extending along the suction chamber with a gap relative to the partition wall for defining the suction chamber. The outer wall has a plurality of portions projecting toward the partition wall on a radially inner surface of the outer wall. The plurality of projecting portions are arranged at an interval in a circumferential direction of the outer wall. Each of the projecting portions has an arc-projecting surface facing the partition wall, and an inclined surface facing the partition wall and extending from each side of the arc-projecting surface to the radially inner surface of the outer wall.

The reciprocating compressor may be constructed as an inclined plate type compressor. For example, the reciprocating compressor includes a center housing having a crank chamber therein, and a cylinder block with a plurality of bores at a rear end of the center housing. A front housing is provided at a front end of the center housing for closing the crank chamber. A drive shaft is rotatably supported, for example, by the cylinder block and the front housing. An inclined plate mechanism is provided on the drive shaft. A plurality of pistons are provided, respectively, in the plurality of bores and reciprocated by an operation of the inclined plate mechanism. A cylinder head connects to a rear end of the cylinder block via a valve plate. The cylinder head includes the partition wall, the outer wall, the plurality of projecting portions, the arc-projecting surfaces and the inclined surfaces.

In the reciprocating compressor, a plurality of convex surfaces and a plurality of concave surfaces may be formed on an radially outer surface of the partition wall. The convex surfaces and the concave surfaces may be arranged alternately in a circumferential direction of the radially outer surface of the partition wall to form a curved surface. Each of the arc-projecting surfaces faces each of the concave surfaces, and each of the inclined surfaces faces each of the convex surfaces.

A chamfered portion may be formed on an radially outer surface of the outer wall at a position corresponding to a side, preferably each side, of the arc-projecting surface by reducing a thickness of the outer wall. The chamfered portion may be formed as a curved surface.

In the reciprocating compressor according to the present invention, the side portion adjacent to the arc-projecting portion is varied by the portion forming the inclined surface, such that a break away flow is not generated in the suction chamber. Therefore, the pressure loss due to such a break away flow may be reduced, and the gas may flow uniformly in the suction chamber. The volume of the gas sucked into the bores may be uniform, and the suction efficiency may be increased. Moreover, the uniformity of the gas flow may reduce a pulsation of the suction, thereby preventing the generation of vibration and noise. Such advantages may be obtained by the structure of the radially inner surface of the outer wall, without increasing the axial length of the compressor. Therefore, the operability of the compressor may be increased, as well as a reduced weight and size.

Moreover, if the chamfered portions are formed on the outer surface of the outer wall, the weight of the compressor may be further reduced without affecting the uniform gas flow in the suction chamber.

Further objects, features, and advantages of the present invention will be understood from the following detailed description of the preferred embodiment of the present invention with reference to the accompanying figures.

BRIEF DESCRIPTION OF THE DRAWINGS

An embodiment of the invention is now described with reference to the accompanying figures, which is given by way of example only, and is not intended to limit the present invention.

DETAILED DESCRIPTION OF A PREFERRED EMBODIMENT

Figure 1:
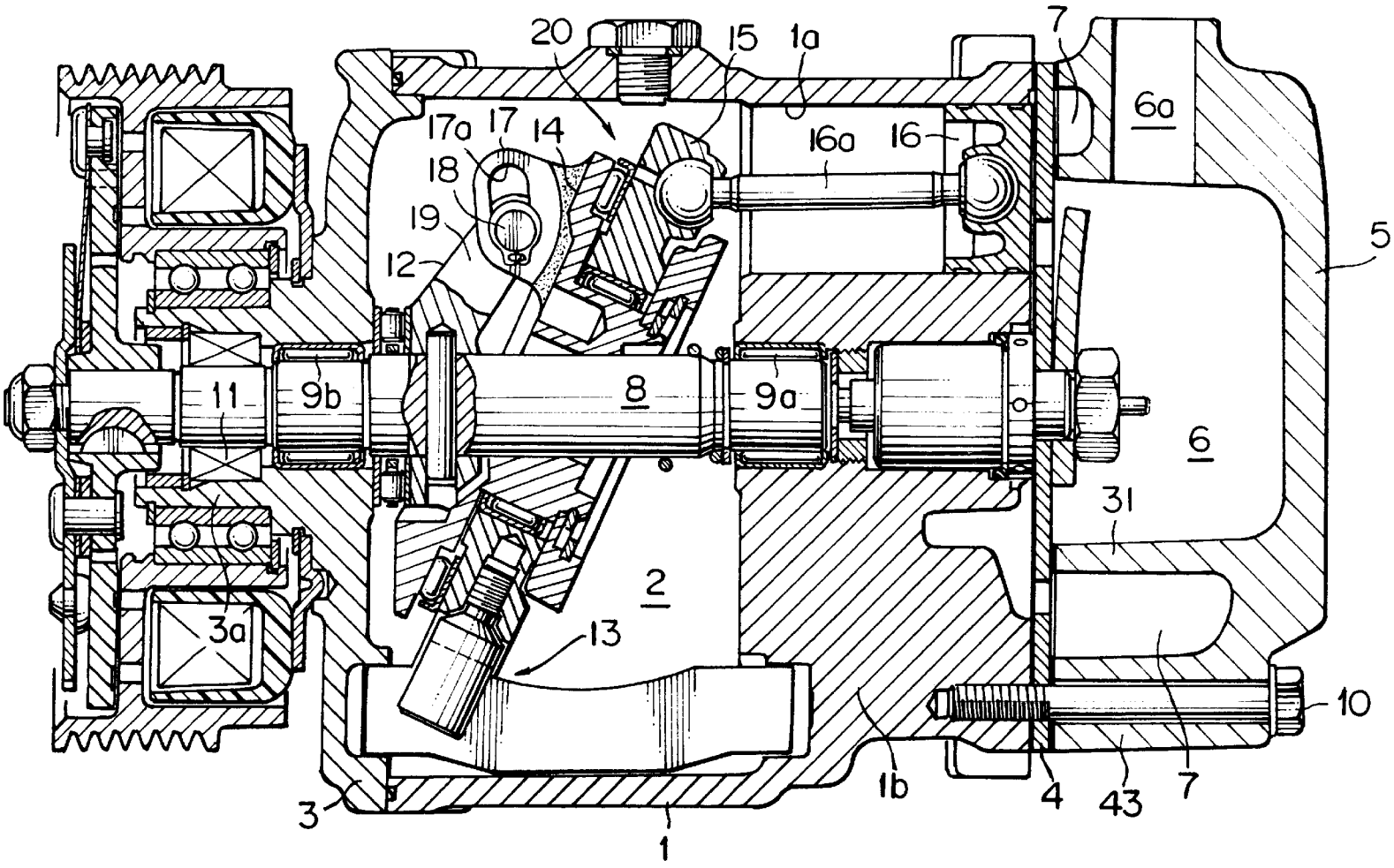
FIG. 1 is a vertical sectional view of a reciprocating compressor according to an embodiment of the present invention.
Figure 2:
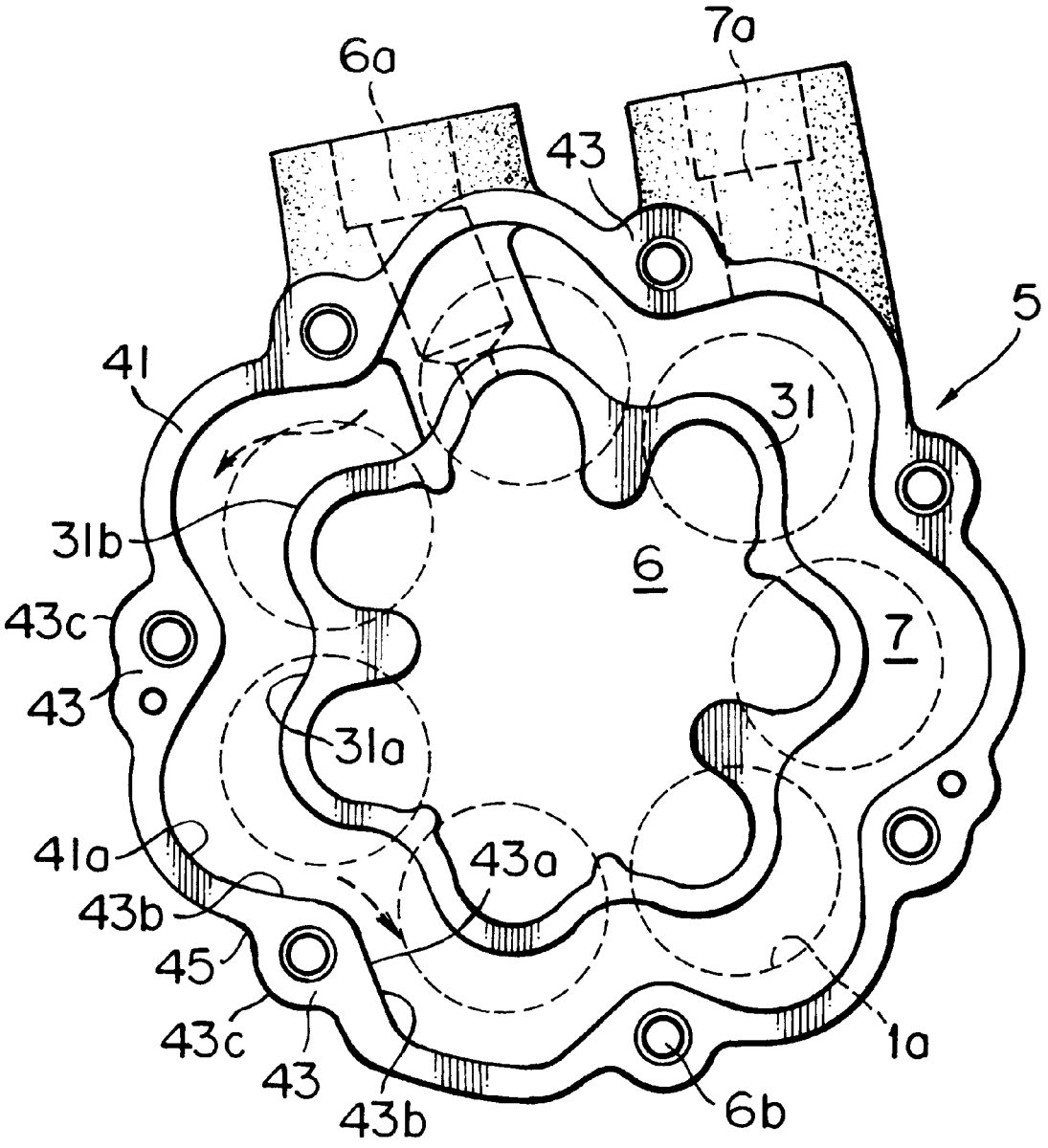
FIG. 2 is a cross-sectional view of a cylinder head of the reciprocating compressor depicted in FIG. 1.
Figure 3:
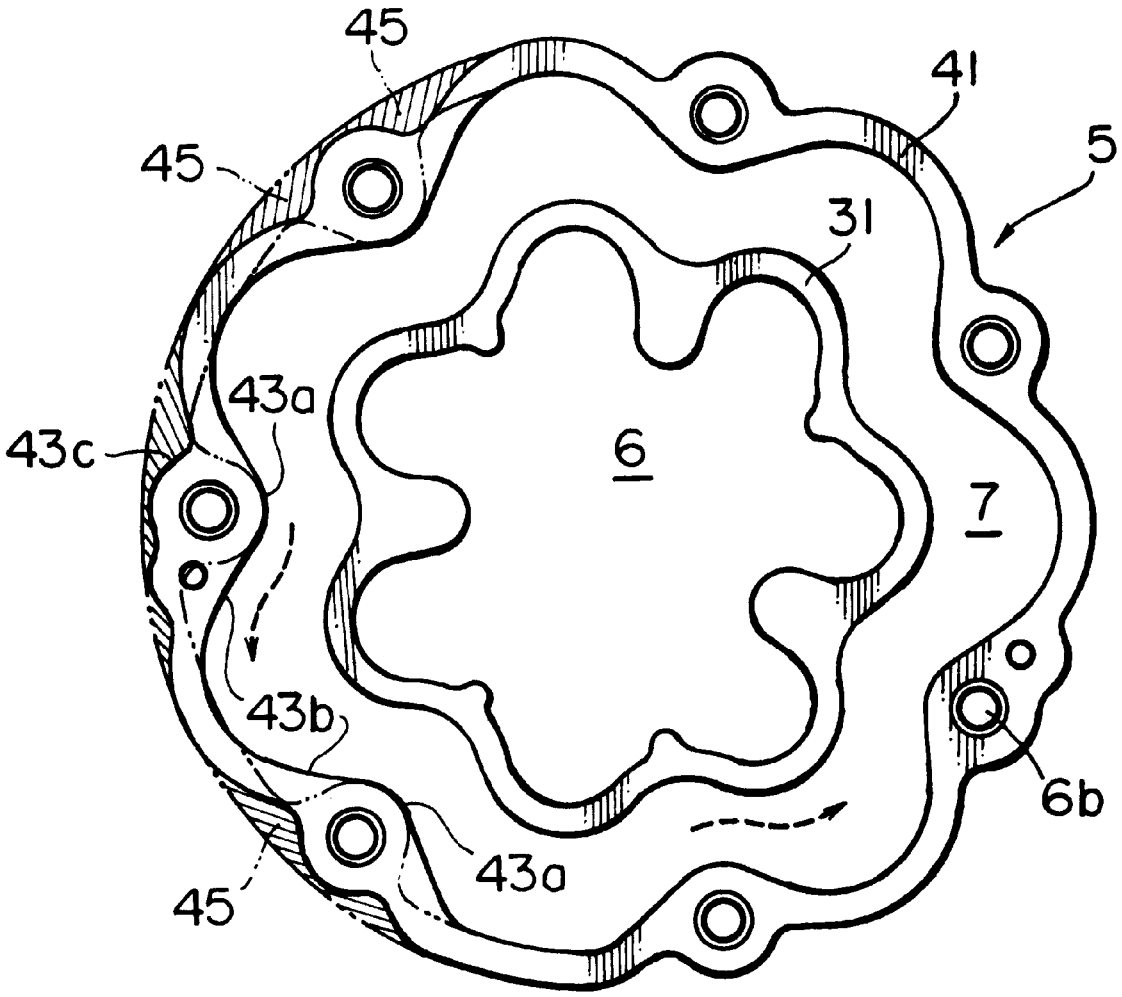
FIG. 3 is a cross-sectional view of the cylinder head depicted in FIG. 2.

Referring to FIGS. 1–3, a reciprocating compressor according to an embodiment of the present invention is provided. In FIG. 1, the reciprocating compressor has center housing 1 forming crank chamber 2. The rear side portion of center housing 1 is formed as a cylinder block 1*b* having a plurality of bores 1*a*. Bores 1*a* are arranged in the circumferential direction of cylinder block 1*b*, as depicted in FIG. 2. Front housing 3 is provided at the front end of center housing 1. Front housing 3 encloses crank chamber 2. Drive shaft 8 is supported rotatably by cylinder block 1*b* and front housing 3 via radial bearings 9*a* and 9*b*. Axial sealing mechanism 11 is provided in cylindrical portion 3*a* of front housing 3.

Pistons 16 are inserted slidably into each bore 1*a* of cylinder block 1*b*. Each piston 16 is connected to piston rod 16*a* via a spherical joint. Each piston rod 16*a* is connected to an inclined plate mechanism 20 via another spherical joint. These elements constitute a reciprocating mechanism for compressing gas sucked into bores 1*a* by reciprocating pistons 16.

Referring to inclined plate mechanism 20, rotor 12 is fixed onto drive shaft 8 in crank chamber 2. Rotor 12 rotates synchronously with the rotation of drive shaft 8. Inclined plate 14 is supported on drive shaft 8. Bracket 17, having a hinge mechanism, is provided on the front surface of inclined plate 14. Support arm 19 is provided on the rear side of rotor 12. Support arm 19 forms the hinge mechanism with bracket 17. By inserting a guide pin 18 on support arm 19 into a slot 17*a* formed in bracket 17, the inclination motion of inclined plate 14 is restricted, as inclined plate 14 rotates synchronously with the rotation of drive shaft 8. Wobble plate 15 is provided on the rear side of inclined plate 14. The rotation of wobble plate 15 is restricted by rotation preventing mechanism 13. Each piston rod 16*a* connects to the rear side of wobble plate 15. Piston rods 16*a* and pistons 16 are driven reciprocally by the wobble motion of wobble plate 15 caused by the rotation of inclined plate 14.

Cylinder head 5 connects to the rear side of cylinder block 1*b* via valve plate 4. Discharge chamber 6 is formed in cylinder head 5 at a radially central portion of the compressor. Suction chamber 7 is formed around discharge chamber 6 and extends in the circumferential direction of discharge chamber 6 at a radially outer portion of discharge chamber 6. A gas to be compressed, such as a refrigerant gas, is sucked into suction chamber 7 through suction port 7*a*. The gas then is sucked from suction chamber 7 into bores 1*a* by the motion of pistons 16, and is compressed in bores 1*a*. The compressed gas is discharged from bores 1*a* into discharge chamber 6, and is discharged through discharge port 6*a*. During compressor operation, the inclination angle of inclined plate 14 is controlled by an adjusting mechanism in response to the pressure difference between the pressure in crank chamber 2 and the pressure in suction chamber 7 (not shown).

In cylinder head 5, as depicted in FIG. 2, partition wall 31 separates suction chamber 7 from discharge chamber 6. Outer wall 41 extends along suction chamber 7 in the circumferential direction with a gap relative to partition wall 31 for defining suction chamber 7. A plurality of concave surfaces 31*a* and a plurality of convex surfaces 31*b* are formed on the radially outer surface of partition wall 31. Concave surfaces 31*a* and convex surfaces 31*b* are arranged alternately in the circumferential direction of the radially outer surface of partition wall 31 to form a curved surface.

Outer wall 41 has a plurality of projecting portions 43 on radially inner surface 41*a*. Projecting portions 43 are arranged in a circumferential direction at a predetermined interval. Each projecting portion 43 projects toward partition wall 31. Each projecting portion 43 has an arc-projecting surface 43*a* facing partition wall 31, and an inclined surface 43*b* facing partition wall 31 that extends from each side of arc-projecting surface 43*a* to radially inner surface 41*a* of outer wall 41. Each arc-projecting surface 43*a* faces a corresponding concave surface 31*a* of partition wall 31, and each inclined surface 43*b* faces the side portion of a corresponding convex surface 31*b* of partition wall 31. A screw hole 6*b* is provided in each projected portion 43 into which a bolt 10, as depicted in FIG. 1 is inserted for fastening cylinder head 5 to cylinder block 1*b* via valve plate 4.

Figure 4:
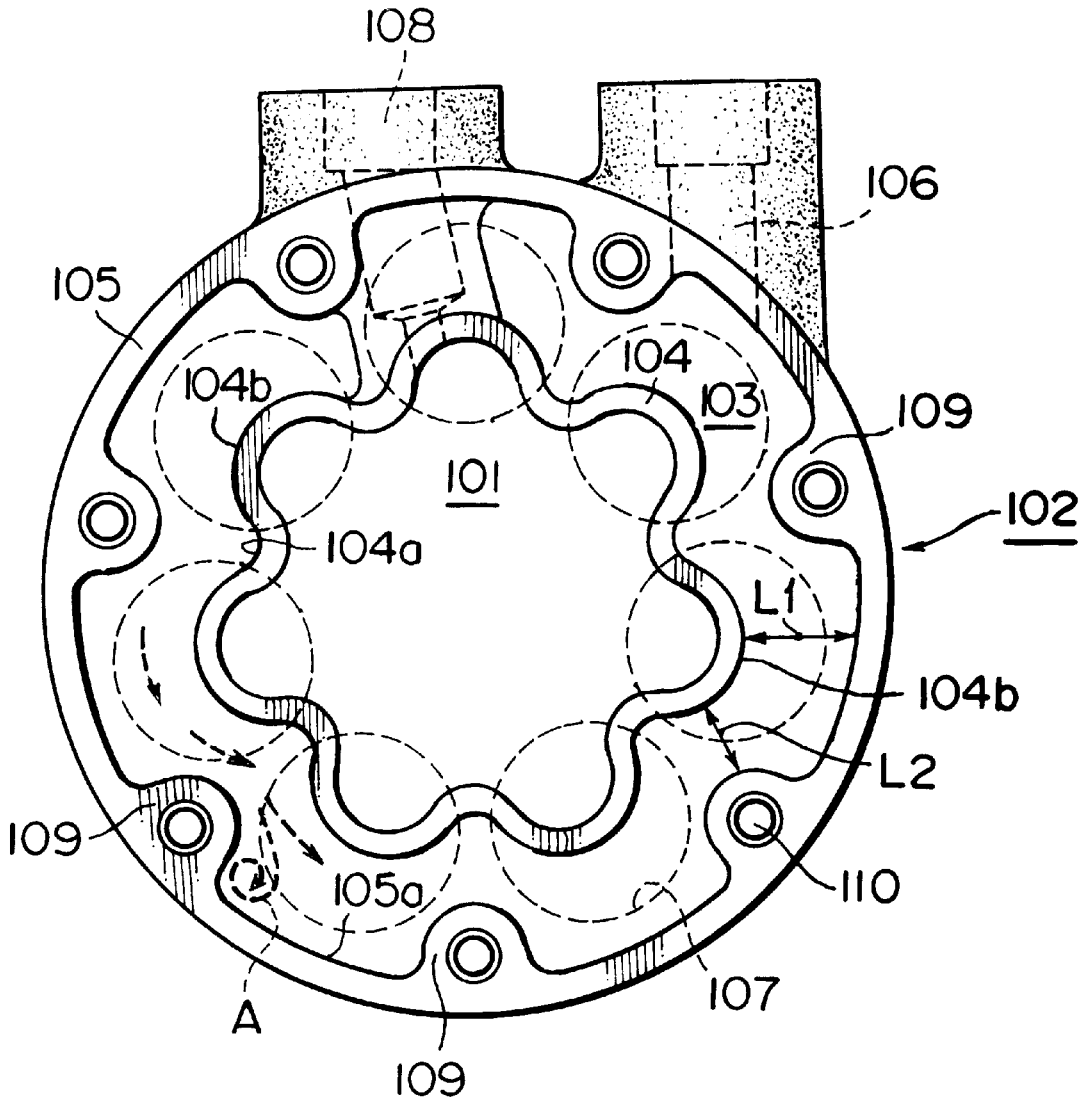
FIG. 4 PRIOR ART
FIG. 4 is a cross-sectional view of a cylinder head of a conventional reciprocating compressor.

Further, as depicted in FIG. 3, a chamfered portion 45 is formed by reducing the thickness of outer wall 41 on the radially outer surface of outer wall 41 at a position corresponding to each side of arc-projecting surface 43*a*. Chamfered portion 45 is a curved surface. The portion between adjacent chamfered portions 45, located at a position corresponding to arc-projecting surface 43*a*, is formed as an arc-projecting curved surface 43*c* which projects outwardly. In FIG. 3, a chain line depicts a configuration of an outer wall of a conventional compressor, such as one depicted in FIG. 4, is depicted.

Referring to FIGS. 2 and 3, each inclined surface 43*b* of outer wall 41 is formed not to generate a break away flow. Therefore, in the gas flow depicted by dashed arrows in FIGS. 2 and 3, such a break away flow may not occur. The gas flows smoothly in suction chamber 7 along inner surface 41*a* of outer wall 41 and the outer surface of partition wall 31. Consequently, pressure loss due to the break away flow may be reduced, and the volume of gas sucked into respective bores 1*a* may be uniform. Further, the suction efficiency into bores 1*a* may be increased.

Moreover, a pulsation does not occur when the gas flows in suction chamber 7, or when the gas is sucked into respective bores 1*a*. Therefore, vibration and noise due to the pulsation may be reduced.

Because it is not necessary to enlarge the axial length of the compressor in the present invention, the compressor size may be reduced, particularly in the axial direction, as compared with the compressor disclosed in Japanese Utility Model Laid-Open 61-145884 or JP-A-7-139463. Moreover, the weight of the compressor may be reduced by the described configuration in the axial direction.

Further, because chamfered portions 45 may be provided on the outer surface of outer wall 41, the compressor weight may be further reduced.

Although only one embodiment of the present invention has been described in detail herein, the scope of the invention is not limited thereto. It will be appreciated by those skilled in the art that various modifications may be made without departing from the scope of the invention. Accordingly, the embodiment disclosed herein is only exemplary. It is to be understood that the scope of the invention is not to be limited thereby, but is to be determined by the claims which follow.

What is claimed is:

1. A reciprocating compressor including a discharge chamber provided at a radially central portion of said compressor, a suction chamber extending in a circumferential direction of said discharge chamber at a radially outer portion around said discharge chamber, and a reciprocating mechanism for compressing a gas introduced through said suction chamber and discharging said compressed gas into said discharge chamber, said reciprocating compressor comprising:

a partition wall separating said suction chamber from said discharge chamber, and;

an outer wall extending along said suction chamber with a gap relative to said partition wall for defining said suction chamber, said outer wall having a plurality of portions projecting toward said partition wall on a radially inner surface of said outer wall, said plurality of projecting portions being arranged at an interval in a circumferential direction of said outer wall, each of said plurality of projecting portions having an arc-projecting surface facing said partition wall, and an inclined surface facing said partition wall and extending from each side of said arc-projecting surface to said radially inner surface of said outer wall.

2. The reciprocating compressor of claim 1, wherein said reciprocating compressor further includes a center housing forming a crank chamber therein and having a cylinder block with a plurality of bores at a rear end of said center housing, a front housing provided at a front end of said center housing for closing said crank chamber, a drive shaft, an inclined plate mechanism provided on said drive shaft, a plurality of pistons provided in said plurality of bores and reciprocated by an operation of said inclined plate mechanism, and a cylinder head connected to a rear end of said cylinder block via a valve plate, and said cylinder head including said partition wall, said outer wall, said plurality of projecting portions, said arc-projecting surfaces and said inclined surfaces.

3. The reciprocating compressor of claim 1, wherein a plurality of convex surfaces and a plurality of concave surfaces are formed on an radially outer surface of said partition wall, said convex surfaces and said concave surfaces are arranged alternately in a circumferential direction of said radially outer surface of said partition wall to form a curved surface, each of said arc-projecting surfaces faces each of said concave surfaces, and each of said inclined surfaces faces each of said convex surfaces.

4. The reciprocating compressor of claim 1, wherein a chamfered portion is formed on an radially outer surface of said outer wall at a position corresponding to a side of said arc-projecting surface.

5. The reciprocating compressor of claim 4, wherein said chamfered portion is formed as a curved surface.

* * * * *